United States Patent [19]

Rudd et al.

[11] 4,236,942

[45] Dec. 2, 1980

[54] METHOD FOR THE GASEOUS NITRIDING OF FERROUS-BASED COMPONENTS

[75] Inventors: Frederick V. Rudd, Blackburn, England; Tom Bracewell, deceased, late of Blackpool, England, by Bertha Bracewell, administratrix

[73] Assignee: British Leyland UK Limited, London, England

[21] Appl. No.: 908,892

[22] Filed: May 23, 1978

[30] Foreign Application Priority Data

May 31, 1977 [GB] United Kingdom ..... 23011/77

[51] Int. Cl.[3] ..... C23C 9/14

[52] U.S. Cl. ..... 148/16.6; 148/31.5

[58] Field of Search ..... 148/16.6, 31.5

[56] References Cited

U.S. PATENT DOCUMENTS

| | | | |
|---|---|---|---|
| 1,647,847 | 11/1927 | Wills | 148/31.5 |
| 3,219,494 | 11/1965 | Hartner et al. | 148/16.6 |
| 3,265,541 | 8/1966 | Elias | 148/16.6 |
| 3,377,214 | 4/1968 | Woodbridge et al. | 148/16.6 |
| 3,399,085 | 8/1968 | Knechtel et al. | 148/16.6 |
| 3,998,666 | 12/1976 | Cuddy et al. | 148/16.6 |
| 4,011,111 | 3/1977 | Hook | 148/16.6 |
| 4,046,601 | 9/1977 | Hook | 148/16.6 |

*Primary Examiner*—L. Dewayne Rutledge
*Assistant Examiner*—John P. Sheehan
*Attorney, Agent, or Firm*—Brisebois & Kruger

[57] ABSTRACT

A ferrous-based component is nitrided by subjecting the heated component to an atmosphere of ammonia and then to an atmosphere of an inert gas. The undesirable nitrogen-rich layer which was hitherto produced at the surface of the component in nitriding is reduced or eliminated in the process of the invention.

9 Claims, No Drawings

METHOD FOR THE GASEOUS NITRIDING OF FERROUS-BASED COMPONENTS

This invention relates to a method for the production of a hard nitrided case at the surface of steel, or other ferrous-based components. The process of gaseous nitriding of steel is well known and is in wide commercial usage. In its basic form the steel is heated to temperatures typically of the order of 490°–550° C. in an atmosphere of ammonia gas which as a result of the temperature, the presence of catalytic metal surfaces dissociates into nascent nitrogen and hydrogen. The nascent nitrogen combines with the steel component to form a hard durable nitrided layer with desirable engineering properties.

As the nitriding process is a diffusion phenomenon, the penetration of nitrogen into the steel creates a nitrogen gradient with its highest concentration at the outer surface. The tendency for nitrogen to be absorbed by the steel is a function of the relative activity of the nascent nitrogen in the furnace atmosphere. This activity is referred to as the nitriding potential which amongst other factors is dependent on the chemical composition of the atmosphere in particular the ratio of nascent nitrogen to other gaseous constituents.

In conventional nitriding processes, the steel after treatment is left with a very nitrogen-rich layer at the extreme surface. During the process this layer serves to provide a reservoir of nitrogen to feed nitrogen into the interior of the steel to produce the required depth of nitrided layer but the residual nitrogen-rich layer at the end of the process is very undesirable. It is commonly referred to as 'white layer' because of its appearance on microscopic examination. It has been shown to consist of the phases $Fe_2N$ ($\epsilon$ phase) and $Fe_4N$ ($\Gamma'$ phase) and is typically of the order of 0.0008 inches in depth and is also commonly referred to as an iron nitride surface layer. During use of the nitrided component, the nitrogen-rich white layer (the iron nitride surface layer) may exfoliate and break away causing damage for example in bearings carrying a rotating nitrided shaft such as an engine crankshaft.

Many attempts have been made to obviate or reduce the nitrogen-rich layer at the surface of the component. An example is to reduce the nitriding potential of the gaseous atmosphere in the furnace by the introduction of an admixture of a second gas for example hydrogen or nitrogen into the ammonia used to produce the nitriding effect.

The invention provides a method of nitriding a ferrous-based component which comprises subjecting the heated component, which has previously been subjected when heated to an atmosphere of ammonia, to an atmosphere of gas inert to the component at the temperature of the component in the inert gas.

When the heated component is subjected to the inert gas, the nitrogen from the nitrogen-rich surface ('white') layer diffuses into the component and into the atmosphere without being continuously replaced as it was in the ammonia. The nitrogen-rich layer is thus reduced or eliminated in the method of the invention. As compared with prior attempts to reduce the nitrogen-rich layer by attempting to control the nature and amount of residual nitrogen-rich layer in the nitrided component by the reduction of the nitrogen potential during the whole of the nitriding process by an admixture of a second gas with the ammonia, a separate stage is employed in the method of the invention which by proper selection of the temperature, time and gas flow sequences reduces or eliminates the presence of the undesirable white layer phases at the nitrided surface.

Advantageously, the temperature of the component in the inert gas lies between 450° C. and 600° C., preferably between 490° C. and 550° C. The component may be subjected to the inert gas for at least twenty hours, and preferably between twenty and sixty hours.

Advantageously, the temperature of the component when it was subjected to the ammonia was between 450° C. and 600° C. and the time for which it was subjected to ammonia was between twenty and sixty hours.

Advantageously, the steps of subjecting the component to the ammonia and of subjecting the component to the inert gas are carried out consecutively, the inert gas replacing the ammonia.

The temperature of the component in both steps of the nitriding operation and the time taken for both steps affect the quality of the nitrided case and these quantities are to some extent interdependent. Thus, for example, a lower temperature would give a good hardness but would require a longer time. Equally, a higher temperature would require a shorter time while the case might not be quite so hard. Thus, the total duration of the two steps may be in the region of sixty-seven to ninety-seven hours at between 495° C. and 505° C. or in the region of forty-three to fifty-three hours at a temperature between 535° C. and 545° C. The first part (for example, the first fifth or quarter) of the process may be carried out at a slightly lower temperature, say around 510° C. in the second case. The ratio of the time in the inert gas to the total time in the inert gas and the ammonia may be between one quarter and three quarters but is preferably in the region of one half. Thus, the nitriding cycle is divided typically into two equal halves. In the first stage ammonia gas may be introduced into a heated furnace at a predetermined rate of flow and the steel or other ferrous component is allowed to absorb nitrogen in a manner similar to a conventional nitriding furnace including the production at the surface of the customary nitrogen-rich iron nitride surface layer or white layer. In the second stage the furnace temperature may be maintained but the flow of ammonia gas is turned off and nitrogen gas is substituted at a similar rate of flow.

As in conventional nitriding, ammonia is made to flow past the component, the flow depending on the volume of the furnace in which the component is located: for example, in a 54 cu ft furnace, a flow of 9 cu ft per hour would be sufficient but 25 cu ft per hour and upwards would work. Although the inert gas may be sealed in the furnace for the second step of the process, a flow of that gas is desirable since apart from flushing out the ammonia, a slight pressure can be maintained with a flow of the gas thereby avoiding problems of having to make the furnace gas-tight.

As regards the composition of the components, in general any of the steels used for conventional nitriding may be used in the process of the invention. For example, BS 970 steel may be used (that is, EN 40B which is a 3% chrome molybdenum steel; EN19 which is a 1% chrome molybdenum steel; or EN 41A which is a 3% chrome aluminium steel); or a 2% chrome molybdenum steel may be used. Alternatively, the process can be used on any other ferrous-based component which it is desired to nitride, for example, mild steel or even cast-iron.

The inert gas may be a noble gas, for example, argon but nitrogen is preferred for cheapness.

EXAMPLE

Components made from a conventional nitriding steel containing nominally 0.25% carbon, 3.00% chromium and 0.5% molybdenum were placed in a nitriding container of 56 cu ft capacity. After purging free from air they were nitrided for a total time of 48 hours.

For the first 12 hours of the process, the furnace temperature was raised to and maintained at 510° C. and for the remaining 36 hours was raised to and maintained at 540° C. For the first 26 hours of the process, the gas flow consisted of 9 cu ft per hour of ammonia gas nad for the remaining 22 hours it consisted of 9 cu ft per hour of nitrogen gas. As an alternative, the ammonia gas flow could last 24 hours and the nitrogen gas flow 24 hours at the same flow rates.

After this time the nitriding container was removed from the furnace and allowed to cool down maintaining an atmosphere of nitrogen gas during the cooling.

After this treatment the steel components were found to be essentially free from undesirable white layer. A black layer of mainly pure iron at the extreme surface was 0.0005 inches thick overlying a normal nitrided case of total depth 0.025 inches, the case depth to a hardness 600 (Vickers Pyramid Numeral) was 0.010 inches.

Because of the diffusion phenomenon previously referred to, the nitrogen-rich layer at the surface is gradually dissipated, partly by diffusion into the interior of the steel to produce desirable nitrided case characteristics and partly to the atmosphere of the furnace. The nitrogen gas atmosphere present in the second stage of the process has none of the properties associated with the nascent nitrogen produced by the decomposition of the ammonia gas in conventional nitriding and may be thus regarded as inert or even having a negative nitriding potential.

As a result of the depletion of nitrogen from the nitrogen-rich layer which had been formed during the first half of the process, the surface layer on the component consists of pure iron ($\alpha$ iron) which is soft and has none of the undesirable friable and hard characteristics of white layer material. This $\alpha$ iron layer, (since it appears black under the microscope and by analogy with the term white layer) may be referred to as 'black-layer' and is typically of the order of 0.0005 inches thick. If desired it may be readily removed by normal lapping techniques.

The normal nitrided case on the component underlying the black layer produced by our process has satisfactory physical properties and differs little if any from the case produced by conventional nitriding. The times, gas flows and temperatures employed in our process may be varied so as to produce the desired hardness and case depth of nitrided case.

The component may be a crankshaft or a part of a gearbox or differential.

What we claim is:

1. A method of nitriding a ferrous-base alloy component which comprises subjecting the heated component, which has previously been subjected when heated to an atmosphere of ammonia, whereby a nitrided case layer and an iron nitride skin was produced, to an atmosphere of gas inert to the component at the temperature of the component in the inert gas, the temperature of the component in the inert gas lying between 450° C. and 600° C. and the component being subjected to the inert gas for at least twenty hours, whereby the iron nitride skin is at least partly removed without destroying the nitrided case layer.

2. A method as claimed in claim 1 wherein the temperature lies between 490° C. and 550° C.

3. A method as claimed in claim 1 wherein the component is subjected to the inert gas for between 20 and 60 hours.

4. A method as claimed in claim 1 wherein the inert gas is nitrogen.

5. A method as claimed in claim 1 wherein the inert gas is fed past the component.

6. A method as claimed in claim 1 wherein the steps of subjecting the component to the ammonia and of subjecting the component to the inert gas are carried out consecutively, the inert gas replacing the ammonia.

7. A method according to claim 1 further comprising cooling the component to room temperature in an atmosphere of gas inert to the component.

8. A method of nitriding a ferrous-base alloy component which comprises subjecting the component to an atmosphere of ammonia while the component is at a temperature between 450° C. and 600° C. to produce a nitrided case layer and an iron nitride skin on the component, and then subjecting the component to an atmosphere of gas inert to the component at the temperature of the component in the inert gas, the temperature of the component in the inert gas lying between 450° C. and 600° C. and the component being subjected to the inert gas for at least twenty hours, whereby the iron nitride skin is at least partly removed without destroying the nitrided case layer.

9. A method as claimed in claim 8 wherein the component is subjected to the ammonia for between 20 and 60 hours.

* * * * *